US012098487B2

(12) United States Patent
Xia et al.

(10) Patent No.: US 12,098,487 B2
(45) Date of Patent: Sep. 24, 2024

(54) KNITTED FABRIC AND USE THEREOF

(71) Applicants: TORAY FIBERS & TEXTILES RESEARCH LABORATORIES (CHINA) CO., LTD., Jiangsu (CN); TORAY INTERNATIONAL (CHINA) CO., LTD., Shanghai (CN)

(72) Inventors: Hongxia Xia, Jiangsu (CN); Qiang Wang, Jiangsu (CN); Chao Guo, Jiangsu (CN); Hongchuan Jing, Jiangsu (CN)

(73) Assignees: TORAY FIBERS & TEXTILES RESEARCH LABORATORIES (CHINA) CO., LTD., Jiangsu (CN); TORAY INTERNATIONAL (CHINA) CO., LTD., Shanghai (CN)

( * ) Notice: Subject to any disclaimer, the term of this patent is extended or adjusted under 35 U.S.C. 154(b) by 42 days.

(21) Appl. No.: 18/009,143

(22) PCT Filed: Jun. 11, 2021

(86) PCT No.: PCT/CN2021/099572
§ 371 (c)(1),
(2) Date: Dec. 8, 2022

(87) PCT Pub. No.: WO2021/254258
PCT Pub. Date: Dec. 23, 2021

(65) Prior Publication Data

US 2023/0250566 A1 Aug. 10, 2023

(30) Foreign Application Priority Data

Jun. 15, 2020 (CN) ..... 202010540387.5

(51) Int. Cl.
*D04B 1/18* (2006.01)
*D04B 1/16* (2006.01)
*D04B 1/24* (2006.01)

(52) U.S. Cl.
CPC ..... *D04B 1/18* (2013.01); *D04B 1/16* (2013.01); *D04B 1/24* (2013.01); *D10B 2201/02* (2013.01); *D10B 2331/04* (2013.01); *D10B 2331/10* (2013.01)

(58) Field of Classification Search
CPC ... D04B 1/12; D04B 1/18; D04B 1/16; D10B 2403/0114; D10B 2403/0214
USPC ..... 66/202, 172 E
See application file for complete search history.

(56) References Cited

U.S. PATENT DOCUMENTS

| | | | | |
|---|---|---|---|---|
| 3,971,234 | A | 7/1976 | Taylor | |
| 7,797,968 | B2 * | 9/2010 | Chuang | D04B 1/18 66/198 |
| 9,689,091 | B2 | 6/2017 | Liao et al. | |
| 2006/0010929 | A1 * | 1/2006 | Chuang | D04B 1/18 66/171 |
| 2012/0036899 | A1 * | 2/2012 | Seno | D01F 8/14 66/170 |
| 2012/0122364 | A1 | 5/2012 | Menczywor | |
| 2013/0260129 | A1 * | 10/2013 | Agzikara | D01H 5/70 428/221 |
| 2015/0354101 | A1 * | 12/2015 | Liao | D02G 3/324 428/377 |
| 2019/0309452 | A1 * | 10/2019 | Liao | D04B 1/18 |

FOREIGN PATENT DOCUMENTS

| | | | |
|---|---|---|---|
| CN | 203475075 | U | 3/2014 |
| CN | 204325675 | U | 5/2015 |
| CN | 104797749 | A | 7/2015 |
| CN | 105980617 | A | 9/2016 |
| CN | 106521784 | A | 3/2017 |
| CN | 107227552 | A | 10/2017 |
| CN | 110114523 | A | 8/2019 |
| CN | 111218764 | A | 6/2020 |
| GB | 1 487 674 | A | 10/1977 |
| JP | 5881661 | A | 5/1983 |
| JP | 2002-004104 | A | 1/2002 |
| JP | 2009-074188 | A | 4/2009 |
| JP | 2019-535916 | A | 12/2019 |
| WO | 2014/075987 | A1 | 5/2014 |

OTHER PUBLICATIONS

International Search Report and Written Opinion for International Application No. PCT/CN2021/099572, dated Sep. 15, 2021, 5 pages.
Office Action (The First Office Action) issued Sep. 14, 2023, by the State Intellectual Property Office of People's Republic of China in corresponding Chinese Patent Application No. 202180042341.3 and an English translation of the Office Action. (12 pages).
Office Action (Notice of Reasons for Refusal) issued Dec. 15, 2023, by the Japan Patent Office in corresponding Japanese Patent Application No. 2022-577096 and an English translation of the Office Action. (14 pages).

* cited by examiner

*Primary Examiner* — Danny Worrell
(74) *Attorney, Agent, or Firm* — Buchanan Ingersoll & Rooney PC

(57) ABSTRACT

A knitted fabric and a use thereof are described, where the knitted fabric is a single-sided knitted fabric including an elastic yarn A and a polyurethane fiber, and a coil surface that includes a coil together formed by the elastic yarn A and the polyurethane fiber that are separately fed, and where the knitted fabric is close to a woven fabric in appearance and performance, has good elasticity, and is particularly suitable for manufacturing coats, trousers, dresses or the like.

7 Claims, No Drawings

KNITTED FABRIC AND USE THEREOF

CROSS REFERENCE TO RELATED APPLICATIONS

This application is the U.S. National Phase application of PCT/CN2021/099572, filed Jun. 11, 2021 which claims priority to Chinese Application No. 202010540387.5, filed Jun. 15, 2020, the disclosures of these applications being incorporated herein by reference in their entireties for all purposes.

FIELD OF THE INVENTION

The present invention relates to a knitted fabric and a use thereof, in particular to a knitted fabric with excellent dimensional stability and a use thereof.

BACKGROUND OF THE INVENTION

It is well-known that knitted fabrics are made of coils in series, and the coils are easy to move, so it has good elasticity and extensibility, but the dimensional stability is relatively poor, and it is easy to detach and deform.

At present, most of the knitted fabrics on the market improve the dimensional stability by adopting a double-sided knit or a double-layer structure. For example, patent document CN203475075U discloses a dimensionally-stable knitted fabric. A bonding fiber and a main yarn raw material are interwoven by a plaiting or plaiting jacquard mode, after weaving is completed, a surface layer of the bonding fiber is fused in a heat setting working procedure, and a fusion node is naturally formed inside the fabric. A contact point between yarns is not easy to slip while the knitted fabric is stretched by an external force, the dimensional stability of the knitted fabric is greatly improved, and the physical style of the fabric is also more inclined to woven fabrics, but the use of the bonding fiber may not only increase the production cost, but also the control of fusion conditions during the heat setting is more cumbersome; in addition, even if the fusion node is hidden in the middle of the fabric, the fusion node may still be exposed to skin in a wearing process due to factors such as stretching, and the wearing comfort is affected.

For another example, patent document CN204325675U discloses a polyester-cotton interwoven weft-knitted concave-convex imitation woven fabric. A front side is composed of a fat pattern yarn area and a ground yarn area, and a reverse side is entirely composed of the ground yarn area, and the ground yarn area is a ground yarn coil area made of a high shrinkage polyester filament yarn. Since the high shrinkage polyester filament yarn on the reverse side is shrunk while heated, the density of the fabric is greatly improved, but the high extensibility of the knitted fabric disappears due to the slip and shrinkage of the coils, and the extensibility is even lower than general fabrics, the wearing comfort is greatly affected.

For another example, patent document JP laid-open 58-81661 discloses a warp-knitted fabric with high elasticity and woven style. The warp-knitted fabric contains more than 5 weight % of a polyurethane elastic fiber, and is formed by two or more warp yarns that are not looped between adjacent coil rows and are continuously inserted in a longitudinal direction. The surface of the warp-knitted fabric presents the woven style interwoven by warp and weft yarns, and the inside has the good dimensional stability because of a warp-knitted structure, but in fact, even if a special warp-knitted process is used, the tightness of the fabric is still insufficient, and the process is complicated and the cost is higher.

SUMMARY OF THE INVENTION

A purpose of the present invention is to provide a knitted fabric with simple process, low production cost, dimensional stability and appearance of a woven fabric, and excellent elasticity, which is suitable for manufacturing coats, trousers, dresses or the like.

A technical scheme of the present invention is as follows.

The knitted fabric of the present invention is a single-sided knitted fabric including an elastic yarn A and a polyurethane fiber, and a coil surface includes a coil together formed by the elastic yarn A and the polyurethane fiber that are separately fed.

In the present invention, since the elastic yarn A and the polyurethane fiber are respectively fed and formed into a loop on the coil surface, the obtained knitted fabric is tightly arranged in coils and is not easily deformed, the appearance is similar to the woven fabric, has good elasticity, and the wearing comfort is greatly improved. No special processing conditions are required, the process is simple and easy, and the cost is low, and it is especially suitable for manufacturing the coats, trousers, dresses or the like.

DETAILED DESCRIPTION OF EMBODIMENTS OF THE INVENTION

In view of the compactness of the fabric, the present invention adopts a single knit structure in which more coils are connected in series with the coils.

The molecular structure of the polyurethane fiber is a chain-like, soft and extensible polyurethane. By connecting with a hard chain segment, it has the higher elasticity and better elastic recovery. Certain shrinkage in a processing process after dyeing may tighten the coils, and the knitted fabric is endowed with an imitation woven style. The polyurethane fiber (PU for short) in the present invention refers to a spandex bare fiber. On the other hand, the elastic yarn A is a non-polyurethane-based elastic yarn, preferably a non-polyurethane-based yarn with a crimp ratio (CR value) of 30~70%. Under a heated condition, such yarns have the higher contractility, and the shrinkage after high-temperature setting may make the coil arrangement more compact. In the present invention, it is considered that these two types are fed separately to form a loop together, and the elastic yarn A is used to make up a gap in the coil, so that the surface of the fabric is densified, and the dimensional stability of the fabric is improved.

In the present invention, if an inelastic yarn and the polyurethane fiber are used to form a loop together, the inelastic yarn may excessively restrain the shrinkage of the polyurethane fiber, so that the fabric is too rigid, and the tightness is not enough. In addition, if the polyurethane fiber is not used and only the elastic yarn A is used to form the loop, since the shrinkage in the processing process after dyeing is relatively small, the coil arrangement is looser, and it is easy to move, thereby the rigidity and stability of the fabric may be affected, and a bubbling problem is prone to occur in the wearing process; and if the coil is tightened by increasing the density, the bubbling problem may be more serious.

It is considered that the yarn on the coil surface of the single knit structure is generally presented in the state of the coils. If the ratio of the above two yarns to form the loop together is less than 50%, the coils may not be closely arranged well, it is possible to affect the rigidity and stability of the fabric. Therefore, in the present invention, preferably the ratio of the above two yarns on the coil surface to form the loop together is 50% or more, and more preferably 80% or more. The ratio of forming the loop together refers to the ratio of the number of the loops formed by the elastic yarn A and the polyurethane fiber in weave repeat accounting for the number of all the loops in the entire weave repeat.

Preferably, in a weave repeat on the warp-wise section of the knitted fabric of the present invention, the area sum S1 of the elastic yarn A and the polyurethane fiber and the total area S2 of the coils in a weave repeat satisfy the following formula: $10 \leq (S1/S2)*100 \leq 35$. A weave repeat here refers to a single structure unit that repeatedly appears in the fabric along a transverse direction. The numerical value of the above relationship formula reflects the size of the shrinkage of the elastic yarn A and the polyurethane fiber. If (S1/S2)*100 is less than 10, there may be problems that the hand feeling of the fabric is soft and the rigidity is insufficient. If (S1/S2)*100 is greater than 35, the hand feeling of the fabric tends to become hard. In the present invention, more preferably it satisfies the following relationship formula: $15 \leq (S1/S2)*100 \leq 30$.

In the present invention, the type of the elastic yarn A is not particularly limited, and may be a single-component elastic fiber, a bi-component composite-type elastic fiber or the like. In the present invention, the elastic yarn A is preferably one or more of a polytrimethylene terephthalate (PTT), a polybutylene terephthalate (PBT), a composite fiber of polytrimethylene terephthalate and polybutylene terephthalate (PTT/PET), a composite fiber of polybutylene terephthalate and polybutylene terephthalate (PBT/PET), and a composite fiber of two polyethylene terephthalates with a viscosity difference (high-viscosity PET/low-viscosity PET). The form thereof is not particularly limited, and may be a fully drawn yarn (FDY) or a draw textured yarn (DTY). These fibers have the higher crimpiness and better rigidity, so the formed fabric is more rigid and stable.

Preferably, the ratio of the total fiber numbers of elastic yarns A to the total fiber numbers of polyurethane fibers to be looped together is 0.5~2.5, more preferably 0.7~2.2, to guarantee the rigidity and elasticity of the fabric. If the ratio between the total fiber numbers of the two is lower than 0.5, there may be problems that the polyurethane fiber is exposed on the reverse side of the fabric and the fabric is shiny. If the ratio of the total fiber numbers of the two is higher than 2.5, the polyurethane fiber may be broken during the weaving process, and the weaving may not be performed. While the elastic yarn A is composited by elastic yarns with different fiber numbers, the average fiber number of the elastic yarn A is calculated firstly, namely the average value of the fiber numbers of all the yarns that constitute the elastic yarn A is calculated firstly, and then the ratio between the average fiber number of the elastic yarn A and the fiber number of the polyurethane fiber is calculated. For example, the elastic yarn A is composited by an elastic yarn a1 and an elastic yarn a2 in a ratio of 2:1, the total fiber number of the elastic yarn a1 is 150 deniers (D for short), and the total fiber number of the elastic yarn a2 is 75 D, the calculation formula of the average fiber number of the elastic yarn A is as follows: $(150 \times 2+75) \div 3=125D$.

In the present invention, the ratio between the coil lengths of the elastic yarn A and the polyurethane fiber to be looped together is also important. While the ratio of the coil lengths of the two is less than or equal to 2.3, the following two problems may occur: (1) a knitting needle may not feed the yarn into the loop smoothly; and (2) the polyurethane fiber protrudes on the surface of the fabric, to form defects, so that the elasticity of the fabric is lost. If the ratio of the two is greater than or equal to 2.8, the following two problems may occur: (1) similarly, the knitting needle may not feed the yarn into the loop smoothly; and (2) the coil arrangement is relatively loose, and prone to produce the movement, the rigidity of the fabric is insufficient, and the elastic yarn A protrudes on the surface of the fabric, to form the defects, so that the appearance of the fabric is affected. Therefore, preferably the ratio of the coil lengths of the two is greater than 2.3 and less than 2.8, and more preferably 2.4~2.7.

The fabric of the present invention preferably contains other yarns (yarn 3) in addition to the elastic yarn A and the polyurethane fiber. The types of other yarns here are not particularly limited, and it is considered that both intramolecular and intermolecular hydrogen bonds of a cellulose fiber may be formed, especially the intramolecular hydrogen bond makes a glycosidic bond unable to rotate, thereby the rigidity is greatly increased. The cellulose fiber here includes a natural fiber and a regenerated cellulose fiber, herein the natural fiber includes cotton, hemp and the like, and the regenerated cellulose fiber includes viscose, tencel and the like. In addition, PET has good mechanical properties, excellent impact stiffness, and good rigidity. Therefore, preferably at least one of the two is used as a raw material for other yarns, and this is easier to maintain the characteristics of the woven style. The natural appearance of the fabric is considered, therefore, the natural fiber is more preferable. The form of the other yarns (yarn 3) is not particularly limited, and may be a long multifilament, a short fiber yarn (pure short fiber yarn or blended short fiber yarn), or a long-short composite yarn. If the yarn is too thin, the stiffness hand feeling is decreased; and if the yarn is too thick, the appearance is rough, and the wearing comfort is decreased. Therefore, while used as the long multifilament or the long-short composite yarn, the fiber number thereof is preferably 100~200 D; and while used as the short fiber yarn, the yarn count thereof is preferably 50~21 English counts.

The structure used in the present invention is not particularly limited, but is preferably moss stitch, variable moss stitch, variable moss twill stitch, variable twill stitch and the like. The variable moss stitch is composited by looping, tucking and thread-floating, and the variable moss twill stitch and the variable twill stitch may be achieved by selecting the number and arrangement order of the looping, tucking and thread-floating. However, it is not limited to this, as long as the single knit structure of which one side is a full-coil structure (the yarns are all looped), and the other side is a change mechanism (such as tucking:thread-floating=1:1; and looping:thread-floating=1:2) other than the full-coil structure may be obtained.

Preferably, the horizontal and vertical elongations of the knitted fabric of the present invention are both 10%~60%, and the elongation recovery rate is above 80%, as to guarantee the wearing comfort of the fabric.

Preferably, the ventilation volume of the knitted fabric of the present invention is 3.0~10.0 $cm^3/cm^2 \cdot s$, as to guarantee the warmth and breathability of the fabric.

Preferably, the bending rigidity of the knitted fabric of the present invention is 0.20~0.35 $gf \cdot cm^2/cm$, and it has an excellent woven fabric style.

According to different seasons and different uses, the knitted fabric of the present invention preferably has a gram weight of 150~400 $g/m^2$, more preferably 200~350 $g/m^2$. It is especially suitable for trousers, coats, dresses or the like.

The knitted fabric of the present invention may be prepared by the following method: on a 22G~36G single circular knitting machine, the elastic yarn A and the polyurethane fiber are at least selected for knitting, the elastic yarn A and polyurethane fiber are simultaneously fed and formed into a loop, and more than 50% of coils on the coil surface are formed by these two types of the yarns together, to obtain a knitted grey fabric, and then the grey fabric is subjected to pre-treatment, dyeing and post-treatment to obtain a knitted product that imitates a woven fabric.

Herein, the processing conditions of the pre-treatment, dyeing, and post-treatment are conventional conditions, and the pre-treatment and the dyeing may be performed in the same bath or separately. In addition, appropriate agents may be added to each project as needed, for example, a scouring agent, a bleaching agents and the like may be added in the pre-treatment, and a hydrophilic agent, an antistatic agent, a neutralizing acid, a softener, a hydrophilic softener and the like may be added in the post-treatment processing. Preferably the antistatic agent is added during the dyeing or the post-treatment processing, as to prevent static electricity and prevent dust while the product is used. The scouring agent, the hydrophilic agent and the like used in the present invention may directly use commercial products, and the dosage of each agent is preferably 0.1~50 g/L.

The present invention is further described below with embodiments and comparative examples. Herein, each physical property parameter involved in the present invention is tested and obtained by the following method.

(1) Area Sum S1 and Total Area S2

A piece of 10 cm*10 cm sample cloth with the elastic yarn A and the polyurethane fiber to be looped together is cut from the fabric. The cloth is flatly placed on a sampling plate, to guarantee that the coils are free from any oblique rows and twists. One coil formed by the elastic yarn A and the polyurethane fiber to be looped together is randomly selected on the sample cloth, its highest point and lowest point are marked, and the distance between the two points is measured, and a position of a middle point is obtained by calculation and marked. Then scanning electron microscope (SEM) sample preparation is performed, a knife blade is used to slice warpwise along the position of the middle mark of the coil, and it is guaranteed that the knife blade and the sample cloth are perpendicular while being sliced. After the sample preparation is completed, cross-section photo shoot is performed. While being shot, it is noted that the sample cloth and a lens of SEM are on the same plane. Under SEM (60 magnifications), a warp-wise cross-section photo containing at least a weave repeat is taken. Under SEM (60 magnifications), one of the weave repeats is selected to take a picture, a picture 1 is obtained, and printed. Firstly the printed picture 1 is fixed with a transparent glass plate, and then an area meter is used to measure the total area of the coils on the picture 1, it is measured for 3 times in the same way, to obtain 3 groups of data, and an average value X1 is taken; and the area sum of the elastic yarn A and the polyurethane fiber is measured, it is measured for 3 times in the same way, to obtain 3 groups of data, and an average value Y1 is taken. Then the weave repeats in different positions are selected to take pictures, a picture 2, a picture 3, a picture 4, a picture 5, a picture 6, a picture 7, a picture 8, a picture 9, and a picture 10 are obtained, X2, X3, X4, X5, X6, X7, X8, X9, X10 and Y2, Y3, Y4, Y5, Y6, Y7, Y8, Y9, Y10 are calculated by a calculation method same as that of the picture 1, the average value of X1~X10 is taken as the total area S2 of the present invention, and the average value of Y1~Y10 is taken as the area sum S1 of the present invention.

(2) Ratio of Coil Lengths Between Elastic Yarn a and Polyurethane Fiber 100 coils (containing both the elastic yarn A and the polyurethane fiber) are taken from the fabric and marked, the lengths of the elastic yarn A and the polyurethane fiber in the 100 coils are measured respectively, and the ratio of the two is calculated. According to the same method, the measurement is repeated for 19 times, and the average value of 20 groups of data is taken as the ratio of the coil lengths of the present invention.

(3) Elastic Elongation and Elongation Recovery Rate

According to a JIS L 1096:2010 B method (constant load method).

(4) Ventilation Volume

According to a JIS L 1096:2010 A method.

(5) Imitation Woven Appearance

The appearance of the fabric is observed by 10 persons. If more than 8 persons think that it has a woven appearance effect, it is rated as excellent, and represented by ○; if 5-7 persons think that it has the woven appearance effect, it is rated as good, and represented by Δ; and if less than 4 persons think that it has the woven appearance effect, it is rated as poor, and represented by X.

(6) CR Value

According to a JIS L 1013 (2010) method.

(7) Bending Rigidity

A rigid-flex B value is tested according to a KES FB2 method.

The rigid-flex B value is larger, and the stiffness feeling of the fabric is stronger.

Embodiment 1

150 D/48 f of PBT/PET DTY (45% of the CR value), 105 D of a PU filament and a 30-English count pure cotton yarn are selected for knitting, herein PBT/PET DTY and the PU filament are fed at the same time, the structure is moss stitch, they are all looped on the reverse side to obtain a grey fabric, then the grey fabric is subjected to the pre-treatment (1 g/L of the scouring agent), intermediate setting, dyeing (dyeing by a disperse dye at 130° C.*30 min, and dyeing by a reactive dye at 60° C.*60 min), and post-treatment processing (1 g/L of the antistatic agent, and 30 g/L of the hydrophilic softener), and the knitted fabric of the present invention is obtained. Each property of the obtained fabric is shown in Table 1.

Embodiment 2

150 D/48 f of PBT/PET DTY (45% of the CR value), 150 D/48 f of ordinary PET DTY, 105 D of a PU filament and a 30-English count pure cotton yarn are selected for knitting, herein PBT/PET DTY and ordinary PET DTY are respectively fed with the PU filament at the same time, PBT/PET DTY and ordinary PET DTY are arranged in a ratio of 1:1, and the rest are the same as in Embodiment 1, to obtain the knitted fabric of the present invention. Each property of the obtained fabric is shown in Table 1.

Embodiment 3

150 D/96 f of PBT/PET DTY (45% of the CR value) is replaced with 150 D/48 f of PTT/PET DTY (42% of the CR value), PTT/PET DTY and PU filament are fed at the same time, the structure is variable moss stitch, and the rest are the same as in Embodiment 1, to obtain the knitted fabric of the present invention. Each property of the obtained fabric is shown in Table 1.

Embodiment 4

150 D/48 f of PBT/PET DTY (45% of the CR value) is replaced with 150 D/48 f of PBT DTY (40% of the CR value), PBT DTY and PU filament are fed at the same time, and the rest are the same as in Embodiment 1, to obtain the knitted fabric of the present invention. Each property of the obtained fabric is shown in Table 1.

Embodiment 5

150 D/48 f of PBT/PET DTY (45% of the CR value) is replaced with 75 D/48 f of PBT/PET DTY (45% of the CR value), and the rest are the same as in Embodiment 1, to obtain the knitted fabric of the present invention. Each property of the obtained fabric is shown in Table 1.

Embodiment 6

75 D/48 f of PBT/PET DTY (45% of the CR value), 50 D of a PU filament and a 50-English count T/C long-short composite yarn (composited by a cotton yarn and 30 D of a PET filament) are selected, and the rest are the same as in Embodiment 1, to obtain the knitted fabric of the present invention. Each property of the obtained fabric is shown in Table 1.

Embodiment 7

75 D/48 f of PBT/PET DTY (45% of the CR value), 30 D of a PU filament and a 40-English count pure cotton yarn are selected for knitting, the structure is variable moss stitch, and the rest are the same as in Embodiment 1, to obtain the knitted fabric of the present invention. Each property of the obtained fabric is shown in Table 1.

Embodiment 8

150 D/96 f of PBT/PET DTY (45% of the CR value), 150 D/48 f of ordinary PET DTY, 105 D of a PU filament and a 30-English count pure cotton yarn are selected for knitting, herein PBT/PET DTY and ordinary PET DTY are respectively fed with the PU filament at the same time, PBT/PET DTY and the ordinary PET DTY are arranged in a ratio of 2:1, the structure is moss twill stitch, and the rest are the same as in Embodiment 1, to obtain the knitted fabric of the present invention. Each property of the obtained fabric is shown in Table 1.

Embodiment 9

150 D/48 f of PBT/PET DTY (45% of the CR value) is replaced with 100 D/48 f of polyamide high-elastic DTY (55% of the CR value), and the rest are the same as in Embodiment 1, to obtain the knitted fabric of the present invention. Each property of the obtained fabric is shown in Table 1.

Embodiment 10

75 D/48 f of PBT/PET DTY (45% of the CR value), 75 D/48 f of ordinary PET DTY, 70 D of a PU filament and a 40-English count T/R short fiber yarn (PET and viscose blended yarn) are selected for knitting, herein PBT/PET DTY and the ordinary PET DTY are respectively fed with the PU filament at the same time, PBT/PET DTY and the ordinary PET DTY are arranged in a ratio of 1:1, and the rest are the same as in Embodiment 1, to obtain the knitted fabric of the present invention. Each property of the obtained fabric is shown in Table 1.

Embodiment 11

The 30-English pure cotton yarn is replaced with a 30-English count PET short fiber yarn, and the rest are the same as in Embodiment 1, to obtain the knitted fabric of the present invention. Each property of the obtained fabric is shown in Table 1.

Embodiment 12

150 D/48 f of PBT/PET DTY (45% of the CR value), 150 D/48 f of PTT/PET DTY (42% of the CR value), 105 D of a PU filament and a 30-English count T/C short fiber yarn (PET and cotton fiber blended yarn) are selected for knitting, herein PBT/PET DTY and PTT/PET DTY are respectively fed with the PU filament at the same time, PBT/PET DTY and PTT/PET DTY are arranged in a ratio of 1:1, and the rest are the same as in Embodiment 1, to obtain the knitted fabric of the present invention. Each property of the obtained fabric is shown in Table 2.

Embodiment 13

150 D/48 f of PET/PET DTY (35% of the CR value), 150 D/48 f of ordinary PET DTY, 70 D of a PU filament and a 30-English count tencel short fiber yarn are selected for knitting, herein PET/PET DTY and ordinary PET DTY are respectively fed with the PU filament at the same time, PET/PET DTY and ordinary PET DTY are arranged in a ratio of 2:1, the structure is variable twill stitch, and the rest are the same as in Embodiment 1, to obtain the knitted fabric of the present invention. Each property of the obtained fabric is shown in Table 2.

Embodiment 14

150 D/48 f of PBT/PET DTY (45% of the CR value), and 105 D of a PU filament are selected for knitting, herein PBT/PET DTY and the PU filament are fed at the same time, the structure is plain stitch, and the rest are the same as in Embodiment 1, to obtain the knitted fabric of the present invention. Each property of the obtained fabric is shown in Table 2.

Embodiment 15

105 D of the PU filament is replaced with 50 D of the PU filament, and the rest are the same as in Embodiment 1, to obtain the knitted fabric of the present invention. Each property of the obtained fabric is shown in Table 2.

Embodiment 16

75 D/48 f of PBT/PET DTY (45% of the CR value), 30 D of a PU filament and 100 D/36 f of ordinary PET DTY are selected for knitting, the structure is variable moss stitch, and the rest are the same as in Embodiment 1, to obtain the knitted fabric of the present invention. Each property of the obtained fabric is shown in Table 2.

Embodiment 17

75 D/48 f of PBT/PET DTY (45% of the CR value) and 30 D of a PU filament are selected for knitting, the structure is variable moss stitch, and the rest are the same as in Embodiment 1, to obtain the knitted fabric of the present invention. Each property of the obtained fabric is shown in Table 2.

Embodiment 18

150 D/48 f of PBT/PET DTY (45% of the CR value), 150 D/48 f of ordinary PET DTY, 105 D of a PU filament and a 30-English count pure cotton short fiber yarn are selected for knitting, herein PBT/PET DTY and ordinary PET DTY are respectively fed with the PU filament at the same time, PBT/PET DTY and ordinary PET DTY are arranged in a ratio of 1:2, the structure is moss twill stitch, and the rest are the same as in Embodiment 1, to obtain the knitted fabric of the present invention. Each property of the obtained fabric is shown in Table 2.

Coats, trousers or dresses are made from the knitted fabrics of Embodiments 1-18.

Comparative Example 1

The PU filament is not used, and the rest are the same as in Embodiment 1, to obtain a knitted fabric. Each property of the obtained fabric is shown in Table 2.

Comparative Example 2

150 D/48 f of PBT/PET DTY (45% of the CR value) is replaced with 150 D/48 f of ordinary PET DTY (16% of the CR value), and the rest are the same as in Embodiment 1, to obtain a knitted fabric. Each property of the obtained fabric is shown in Table 2.

Comparative Example 3

A PU covered yarn formed by 75 D/48 f of PBT/PET DTY (45% of the CR value) and 30 D of a PU filament and a 50-English count T/C long-short composite yarn (composited by a cotton yarn and 30 D of a PET filament) are selected for knitting, and the rest are the same as in Embodiment 1, to obtain a knitted fabric. Each property of the obtained fabric is shown in Table 2.

TABLE 1

| | | Embodiment 1 | Embodiment 2 | Embodiment 3 | Embodiment 4 | Embodiment 5 | Embodiment 6 | Embodiment 7 | Embodiment 8 | Embodiment 9 | Embodiment 10 | Embodiment 11 |
|---|---|---|---|---|---|---|---|---|---|---|---|---|
| Yarn 1 (elastic yarn A) | Type | PBT/PET | PBT/PET | PBT/PET | PBT | PBT/PET | PBT/PET | PBT/PET | PBT/PET | Polyamide | PBT/PET | PBT/PET |
| | Fiber number (D) | 150 | 150 | 150 | 150 | 75 | 75 | 75 | 150 | 100 | 75 | 150 |
| | CR (%) | 45 | 45 | 42 | 40 | 45 | 45 | 45 | 45 | 55 | 45 | 45 |
| Yarn 2 | Type | PU | PU | PU | PU | PU | PU | PU | PU | PU | PU | PU |
| | Fiber number (D) | 105 | 105 | 105 | 105 | 105 | 50 | 30 | 105 | 105 | 70 | 105 |
| Yarn 3 | Type 1 | pure cotton yarn | pure cotton yarn | pure cotton yarn | pure cotton yarn | pure cotton yarn | Long-short composite yarn | pure cotton yarn | pure cotton yarn | pure cotton yarn | T/R short fiber yarn | PET short fiber yarn |
| | Fiber number (English count) | 30 | 30 | 30 | 30 | 30 | 50 | 40 | 30 | 30 | 40 | 30 |
| | Type 2 | — | PET | — | — | — | — | — | PET | — | PET | — |
| | Fiber number (D) | — | 150 | — | — | — | — | — | 150 | | 75 | |
| Ratio of elastic yarn A and PU filament to be looped together (%) | | 100 | 50 | 100 | 100 | 100 | 100 | 100 | 67 | 100 | 50 | 100 |
| Ratio of total fiber numbers of elastic yarn A and PU filament | | 1.4 | 1.4 | 1.4 | 1.4 | 0.7 | 1.5 | 2.5 | 1.4 | 0.95 | 1.1 | 1.4 |
| Structure | | moss stitch | moss stitch | variable moss stitch | moss stitch | moss stitch | moss stitch | variable moss stitch | moss twill stitch | moss stitch | moss stitch | moss stitch |
| (S1/S2)*100 | | 15 | 12 | 23 | 24 | 16 | 18 | 29 | 31 | 26 | 9 | 19 |
| Gram weight ($g/m^2$) | | 345 | 320 | 340 | 335 | 260 | 200 | 250 | 325 | 330 | 240 | 345 |
| Bending rigidity ($gf \cdot cm^2/cm$) | | 0.33 | 0.30 | 0.27 | 0.24 | 0.28 | 0.25 | 0.23 | 0.21 | 0.26 | 0.22 | 0.29 |
| Elongation (%) | Longitudinal direction | 15 | 27 | 19 | 20 | 36 | 32 | 21 | 39 | 26 | 34 | 18 |
| | Transverse direction | 20 | 22 | 24 | 27 | 45 | 36 | 27 | 41 | 32 | 41 | 21 |
| Elongation recovery rate (%) | Longitudinal direction | 89 | 87 | 85 | 83 | 90 | 86 | 82 | 83 | 86 | 82 | 85 |
| | Transverse direction | 88 | 86 | 85 | 82 | 86 | 85 | 82 | 84 | 87 | 81 | 86 |
| Ventilation volume ($cm^3/cm^2 \cdot s$) | | 3.7 | 6.2 | 6.3 | 6.9 | 7.8 | 5.3 | 7.7 | 9.0 | 8.4 | 9.5 | 7.0 |
| Imitation woven appearance | | ○ | ○ | ○ | ○ | ○ | ○ | Δ | Δ | ○ | Δ | ○ |

TABLE 2

| | | Embodiment 12 | Embodiment 13 | Embodiment 14 | Embodiment 15 | Embodiment 16 | Embodiment 17 | Embodiment 18 | Comparative example 1 | Comparative example 2 | Comparative example 3 |
|---|---|---|---|---|---|---|---|---|---|---|---|
| Yarn 1 (elastic yarn A) | Type | PBT/PET, PTT/PET | PET/PET | PET/PET | PET/PET | PET/PET | PET/PET | PET/PET | PET/PET | PET | PU covered yarn |
| | Fiber number (D) | 150 | 150 | 150 | 150 | 75 | 75 | 150 | 150 | 150 | |
| | CR (%) | 45, 42 | 35 | 45 | 45 | 45 | 45 | 45 | 45 | 16 | |
| Yarn 2 | Type | PU | PU | PU | PU | PU | PU | PU | — | PU | — |
| | Fiber number (D) | 105 | 70 | 105 | 50 | 30 | 30 | 105 | — | 105 | — |
| Yarn 3 | Type 1 | T/C short fiber yarn | Tencel short fiber yarn | — | pure cotton yarn | — | — | pure cotton yarn | pure cotton yarn | pure cotton yarn | Long-short composite yarn |
| | Fiber number (English count) | 30 | 30 | — | 30 | — | — | 30 | 30 | 30 | 50 |
| | Type 2 | — | PET | — | — | PET | — | PET | — | — | — |
| | Fiber number (D) | — | 150 | — | — | 100 | — | 150 | — | — | — |
| Ratio of elastic yarn A and PU filament to be looped together (%) | | 100 | 67 | 100 | 100 | 100 | 100 | 33 | — | — | 100 |
| Ratio of total fiber numbers of elastic yarn A and PU filament | | 1.2 | 2.1 | 1.4 | 3.0 | 2.5 | 2.5 | 1.4 | — | 1.4 | 2.5 |
| Structure | | moss stitch | variable twill stitch | plain stitch | moss stitch | variable moss stitch | variable moss stitch | moss twill stitch | moss stitch | moss stitch | moss stitch |
| (S1/S2)*100 | | 21 | 33 | 1 | 27 | 37 | 1 | 7 | 46 | 44 | 42 |
| Gram weight (g/m$^2$) | | 328 | 330 | 310 | 320 | 230 | 180 | 315 | 300 | 310 | 160 |
| Bending rigidity (gf · cm$^2$/cm) | | 0.29 | 0.21 | 0.19 | 0.26 | 0.19 | 0.17 | 0.18 | 0.16 | 0.14 | 0.15 |
| Elongation (%) | Longitudinal direction | 22 | 28 | 48 | 28 | 31 | 43 | 46 | 43 | 43 | 36 |
| | Transverse direction | 31 | 35 | 57 | 37 | 43 | 41 | 59 | 47 | 47 | 38 |
| Elongation recovery rate (%) | Longitudinal direction | 83 | 82 | 80 | 79 | 76 | 80 | 75 | 80 | 80 | 82 |
| | Transverse direction | 85 | 81 | 81 | 80 | 78 | 77 | 78 | 78 | 78 | 80 |
| Ventilation volume (cm$^3$/cm$^2$ · s) | | 6.5 | 9.8 | 22.1 | 8.8 | 11.3 | 23.2 | 18.3 | 33.0 | 19.0 | 12.0 |
| Imitation woven appearance | | ○ | Δ | Δ | Δ | Δ | Δ | Δ | X | X | X |

According to Table 1 and Table 2:

(1) From Embodiment 1 and Embodiment 2, it may be seen that under the same conditions, the knitted fabric of which the ratio of PBT/PET and PU to be looped together is 100% is compared with the knitted fabric of which the ratio of PBT/PET and PU to be looped together is 50%, the imitation woven appearance effects of the two are equivalent, the bending rigidity and elastic recovery of the former are better than those of the latter, and the ventilation volume is lower than that of the latter, in other words, the former is closer to the woven fabric than the latter in terms of both the appearance and performance.

(2) It may be seen from Embodiment 1 and Embodiment 9 that under the same conditions, the knitted fabric using PBT/PET DTY as the elastic yarn A is compared with the knitted fabric using the polyamide high-elastic DTY as the elastic yarn A, the imitation woven appearance effects of the two are equivalent, the elasticity of the former is not as good as that of the latter, but the bending rigidity is larger than that of the latter, and the ventilation volume is much lower than that of the latter. Generally speaking, the former is closer to the woven fabric than the latter in terms of both the appearance and performance.

(3) It may be seen from Embodiment 1 and Embodiment 11 that under the same conditions, the knitted fabric of the yarn 3 using the pure cotton yarn is compared with the knitted fabric of the yarn 3 using the pure polyester short fiber yarn, the imitation woven appearance effects of the two are equivalent, but the ventilation volume of the former is lower than that of the latter, and it has a more natural cotton product appearance, so the overall effect is better than the latter.

(4) It may be seen from Embodiment 1 and Embodiment 14 that, under the same conditions, the knitted fabric using the moss stitch is compared with the knitted fabric using the plain stitch, in terms of the imitation woven appearance, bending rigidity and elastic recovery, the former is greatly superior to the latter.

(5) It may be seen from Embodiment 1 and Embodiment 15 that under the same conditions, the knitted fabric of which the ratio of the total fiber numbers of PBT/PET and PU is 1.4 is compared with the knitted fabric of which the ratio of the total fiber numbers of PBT/PET and PU is 3.0, the bending rigidity of the former is larger than that of the latter, the ventilation volume is much lower than that of the latter, and the imitation woven appearance effect is better than that of the latter, in other words, the former is far superior to the latter in terms of both the appearance and performance.

(6) It may be seen from Embodiment 7 and Embodiment 16 that under the same conditions, the knitted fabric of which (S1/S2)*100 is 29 is compared with the knitted fabric of which (S1/S2)*100 is 37, the bending rigidity of the former is larger than that of the latter, the ventilation volume is much lower than that of the latter, and the imitation woven appearance effect is better than that of the latter, in other words, the former is far superior to the latter in terms of both the appearance and performance.

(7) It may be seen from Embodiment 7 and Embodiment 17 that under the same conditions, the knitted fabric of which (S1/S2)*100 is 29 is compared with the knitted fabric of which (S1/S2)*100 is 1, the bending rigidity of the former is larger than that of the latter, the woven appearance effect is better than that of the latter, and the ventilation volume is much lower than that of the latter, in other words, the former is far superior to the latter in terms of both the appearance and performance.

(8) It may be seen from Embodiment 8 and Embodiment 18 that, under the same conditions, the knitted fabric of which the ratio of PBT/PET and PU to be looped together is 67% is compared with the knitted fabric of which the ratio of PBT/PET and PU to be looped together is 33%, the imitation woven appearance effects of the two are equivalent, the bending rigidity and elastic recovery of the former are better than those of the latter, and the ventilation volume is lower than that of the latter, in other words, the former is closer to the woven fabric than the latter in terms of both the appearance and performance.

(9) It may be seen from Comparative example 1 and Embodiment 1 that, under the same conditions, the knitted fabric formed by PBT/PET to be looped alone is compared with the knitted fabric formed by PBT/PET and PU to be looped together, the bending rigidity of the former is small, the elongation is large, the ventilation volume is large, and the imitation woven appearance effect is very poor, in other words, the former has a significant difference from the woven fabric in terms of both the performance and appearance.

(10) It may be seen from Comparative example 2 and Embodiment 1 that, under the same conditions, the knitted fabric formed by ordinary PET DTY and PU to be looped together is compared with the knitted fabric formed by PBT/PET DTY and PU to be looped together, the bending rigidity of the former is smaller, the ventilation volume is larger, and the imitation woven appearance effect is very poor, in other words, the former has a significant difference from the woven fabric in terms of both the performance and appearance.

(11) It may be seen from Comparative example 3 and Embodiment 6 that the knitted fabric obtained by feeding the PU covered yarn formed by PBT/PET short fiber and PU and knitting is compared with the knitted fabric obtained by respectively feeding PBT/PET DTY and PU to be looped together, the bending rigidity of the former is smaller, the ventilation volume is larger, and the imitation woven appearance effect is very poor, in other words, the former has a significant difference from the woven fabric in terms of both the performance and appearance.

The invention claimed is:

1. A knitted fabric, wherein the knitted fabric is a single-sided knitted fabric comprising an elastic yarn A and a polyurethane fiber, and a coil surface comprises a coil together formed by the elastic yarn A and the polyurethane fiber that are separately fed, and wherein in a weave-repeat on the warp-wise section of the knitted fabric along a transverse direction, the area sum S1 of the elastic yarn A and the polyurethane fiber and the total area S2 of the coils in a weave-repeat satisfy the following formula:

$$10 \leq (S1/S2)*100 \leq 35.$$

2. The knitted fabric according to claim 1, wherein the elastic yarn A is one or more of a polytrimethylene terephthalate fiber, a polybutylene terephthalate fiber, a polyethylene terephthalate/polytrimethylene terephthalate composite fiber, a polyethylene terephthalate/polybutylene terephthalate composite fiber, and a high-viscosity polyethylene terephthalate/low-viscosity polyethylene terephthalate composite fiber.

3. The knitted fabric according to claim 1, wherein the ratio of the total fiber numbers of elastic yarns A to the total fiber numbers of polyurethane fibers is 0.5~2.5.

4. The knitted fabric according to claim 1, wherein the elongations in the transverse direction and the longitudinal direction of the knitted fabric are both 10%~60%, and the elongation recovery rate is above 80%.

5. The knitted fabric according to claim 1, wherein the ventilation volume of the knitted fabric is 3.0~10.0 $cm^3/cm^2 \cdot s$.

6. The knitted fabric according to claim 1, wherein the bending rigidity of the knitted fabric is 0.20~0.35 $gf \cdot cm^2/cm$.

7. Coats, trousers or dresses made of the knitted fabric according to claim 1.

* * * * *